US008371991B2

(12) United States Patent
Chen

(10) Patent No.: US 8,371,991 B2
(45) Date of Patent: Feb. 12, 2013

(54) BALLOON INFLATING TRAMPOLINE

(76) Inventor: Samuel Chen, Shanghai (CN)

( * ) Notice: Subject to any disclaimer, the term of this patent is extended or adjusted under 35 U.S.C. 154(b) by 310 days.

(21) Appl. No.: 12/893,159

(22) Filed: Sep. 29, 2010

(65) Prior Publication Data

US 2012/0077642 A1 Mar. 29, 2012

(51) Int. Cl.
*A63B 5/11* (2006.01)
*A63G 23/00* (2006.01)
*A63B 26/00* (2006.01)

(52) U.S. Cl. ..... 482/27; 482/77; 172/135

(58) Field of Classification Search ..... 482/23, 482/25, 26, 27, 28, 29, 30, 35, 77; 472/49–51, 472/92–94, 135
See application file for complete search history.

(56) References Cited

U.S. PATENT DOCUMENTS 5,255,624 A * 10/1993 Legare ..... 114/68
5,637,057 A * 6/1997 Collura ..... 482/27
7,361,104 B2 * 4/2008 Levy ..... 473/415
7,494,445 B1 * 2/2009 Chen ..... 482/27
7,909,703 B1 * 3/2011 Semrau et al. ..... 472/135
2005/0043122 A1 * 2/2005 Publicover et al. ..... 473/465
2005/0130804 A1 * 6/2005 Hall ..... 482/28
2005/0209053 A1 * 9/2005 Knox ..... 482/27
2006/0135321 A1 * 6/2006 Chen ..... 482/27
2006/0160664 A1 * 7/2006 Lavabre ..... 482/27
2007/0066447 A1 * 3/2007 Overholt ..... 482/27
2009/0181827 A1 * 7/2009 Hylbert et al. ..... 482/29
2011/0021322 A1 * 1/2011 Schaffer et al. ..... 482/29
2012/0010050 A1 * 1/2012 Smith et al. ..... 482/27

* cited by examiner

*Primary Examiner* — Loan Thanh
*Assistant Examiner* — Sandhara Ganesan
(74) *Attorney, Agent, or Firm* — Clement Cheng

(57) ABSTRACT

A trampoline has a trampoline bed with a bounding surface, and a trampoline bed bounding surface. A trampoline frame holds the bounding surface substantially horizontally to provide an area for a user. A balloon coupler is attached to the trampoline. A bounce module is mounted underneath the trampoline bed bounding surface. The bounce module is placed to receive motion from a user. The user activates a mode of the bounce module during jumping. A conduit hose is attached to the balloon coupler. A one-way valve is configured to regulate flow only to the balloon, and blocking any flow away from the balloon. A pump may pump water or air to the balloon. A balloon is attached to the balloon coupler so that the balloon is in fluid communication with the conduit hose.

20 Claims, 7 Drawing Sheets

BALLOON INFLATING TRAMPOLINE

DISCUSSION OF RELATED ART

Trampolines have been in use for decades as popular backyard entertainment, as well as for Olympic sport. Trampolines generally include a bounding surface, a plurality of springs connecting with the bounding surface to the trampoline frame. Additionally, a plurality of legs extends from the trampoline frame to support the trampoline frame above the ground.

The trampoline has become safer with the advent of the trampoline enclosure. A variety of trampoline enclosure structures have been devised for securing users within a safe area. In Publicover U.S. Pat. No. 6,261,207 issued Jul. 17, 2001, the disclosure of which is incorporated herein by reference, a trampoline enclosure has a support system of independent poles extending from the legs of the trampoline. Publicover improved upon the prior art which had substantially inflexible poles connected as he frame above the trampoline frame structure. The prior art included rope webbing for retaining users within the safe area.

Subsequently, Samuel Chen invented in U.S. Pat. No. 6,679,881 issued Jul. 20, 2004, the disclosure of which is incorporated herein by reference, an air enclosure trampoline safety system relying upon inflatable means for enclosure. Nichols entitled Trampoline Enclosure System in U.S. Pat. No. 6,607,468 issued Aug. 19, 2003, the disclosure of which is incorporated herein by reference, utilized a different method of attaching the enclosure net to poles by means of loops. While the prior art provides a number of configurations, all have .certain advantages and disadvantages.

Trampolines also include auxiliary effects such as in Samuel Chen's lighted trampoline, described in U.S. Pat. No. 7,297,089 issued Nov. 20, 2007, the disclosure of which is incorporated herein by reference. Many of these auxiliary effects have been related to lighting or sound or a combination of the above. Auxiliary effects may include counters, timers and other electronic enhancements.

SUMMARY OF THE INVENTION

The key feature of this invention is to inflate a balloon by having users jump on a trampoline bed.

A trampoline has a trampoline bed with a bounding surface, and a trampoline bed bounding surface. A trampoline frame holds the bounding surface substantially horizontally to provide an area for a user. A balloon coupler is attached to the trampoline. A bounce module is mounted underneath the trampoline bed bounding surface. The bounce module is placed to receive motion from a user. The user activates a mode of the bounce module during jumping. A conduit hose is attached to the balloon coupler. A one-way valve is configured to regulate flow only to the balloon, and blocking any flow away from the balloon. A pump may pump water or air to the balloon. A balloon is attached to the balloon coupler so that the balloon is in fluid communication with the conduit hose.

A plurality of elastic cord attaches to the bounce module at a cord connection area and attaching to the trampoline frame. A trampoline mat fits over a plurality of springs. A plurality of legs formed on the trampoline frame, and supports the trampoline frame above the ground.

An inflatable bag can be installed underneath the trampoline bed bounding surface. The inflatable bag is sized to be pressed between the ground and the trampoline bed. The trampoline bounce module may have a top cover that is light permeable, a bottom cover; and a light element sandwiched between the top cover and the bottom cover. The bounce module could also have a bounce sensor of a spring type bounce sensor.

The bounce module may have a bounce sensor that is electronically connected to the fluid pump to activate the fluid pump when the bounce sensor detects a bounce. The fluid pump inflates a balloon when the bounce sensor detects a bounce. Preferably, the bounce sensor requires more than 20 bounces to pop a balloon. Preferably, bounce sensor requires more than 20 bounces to release a balloon from the nozzle. When the inflatable bag is installed underneath the trampoline bed bounding surface, the inflatable bag is sized to be pressed between the ground and the trampoline bed, so that the inflatable bag is connected to the hose and providing fluid pressure to the hose enough to pump up balloons as kids jump on the trampoline. In this configuration, the pump is configured to inflate the inflatable bag.

The bounce module could also have a bounce sensor electronically connected to the fluid pump to activate the fluid pump when the bounce sensor detects a bounce, so that the fluid pump inflates a balloon when the bounce sensor detects a bounce. The trampoline frame preferably includes a trampoline and enclosure or closure having a trampoline and enclosure netting, so that the balloon coupler is attached to the trampoline at the enclosure netting. The balloon coupler and hose can be held by a pair of opening and reclosable flaps forming a sleeve.

A trampoline has an enclosure and a plurality of support poles. The support poles have a top end. The trampoline also includes a trampoline frame. A trampoline enclosure net is suspended. A trampoline mat is included and the trampoline enclosure net is bounded by the trampoline mat at a lower portion of the trampoline enclosure net. A bounding surface is supported by a plurality of springs connecting between the bounding surface and the trampoline frame, and the trampoline mat fits over the plurality of springs. A plurality of legs secured to the trampoline frame, and supporting the trampoline frame above the ground. The trampoline enclosure net is secured to an interior circumference of the trampoline mat.

Figure 1:
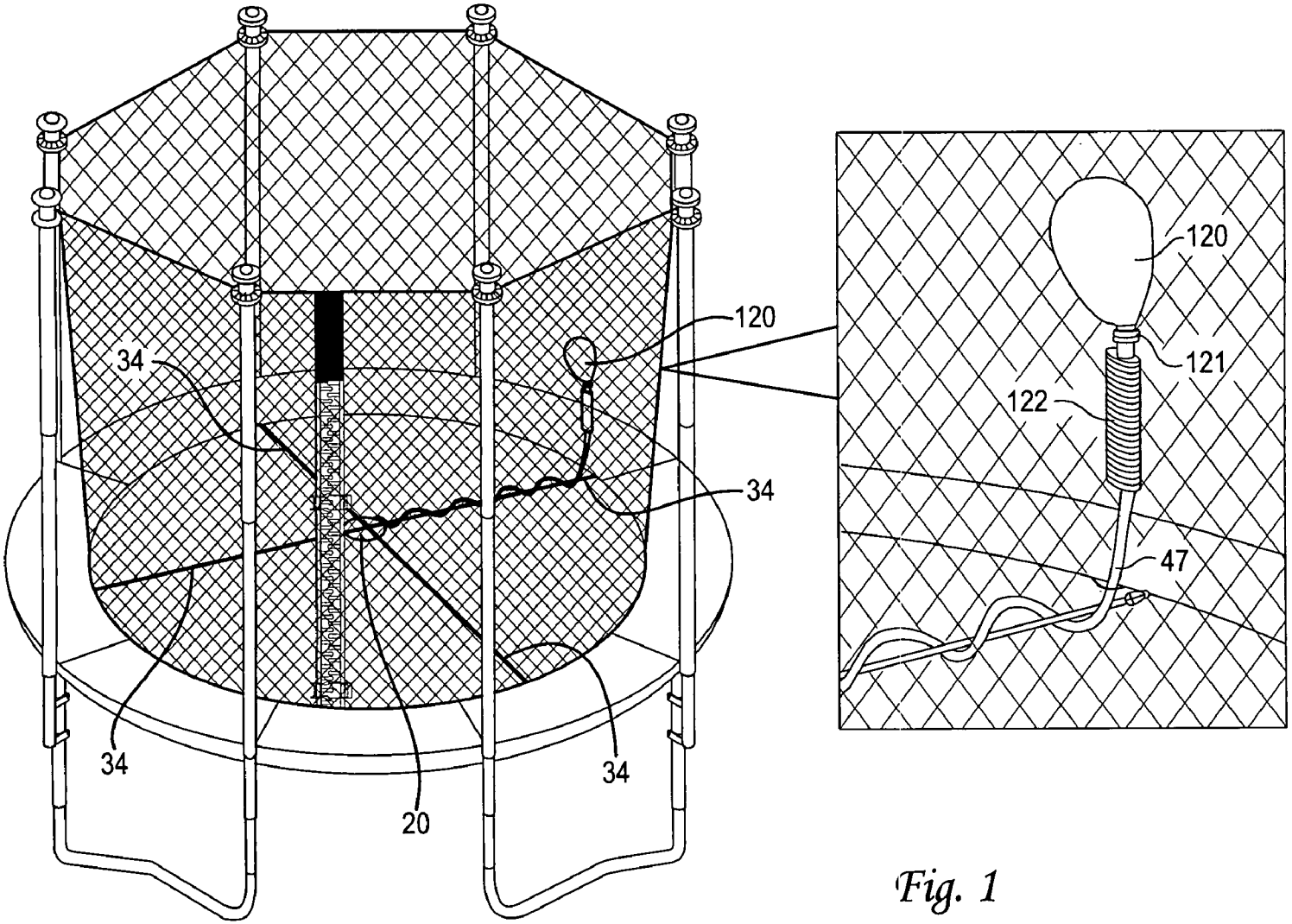
FIG. 1 is a perspective view of the balloon inflating trampoline.
Figure 2:
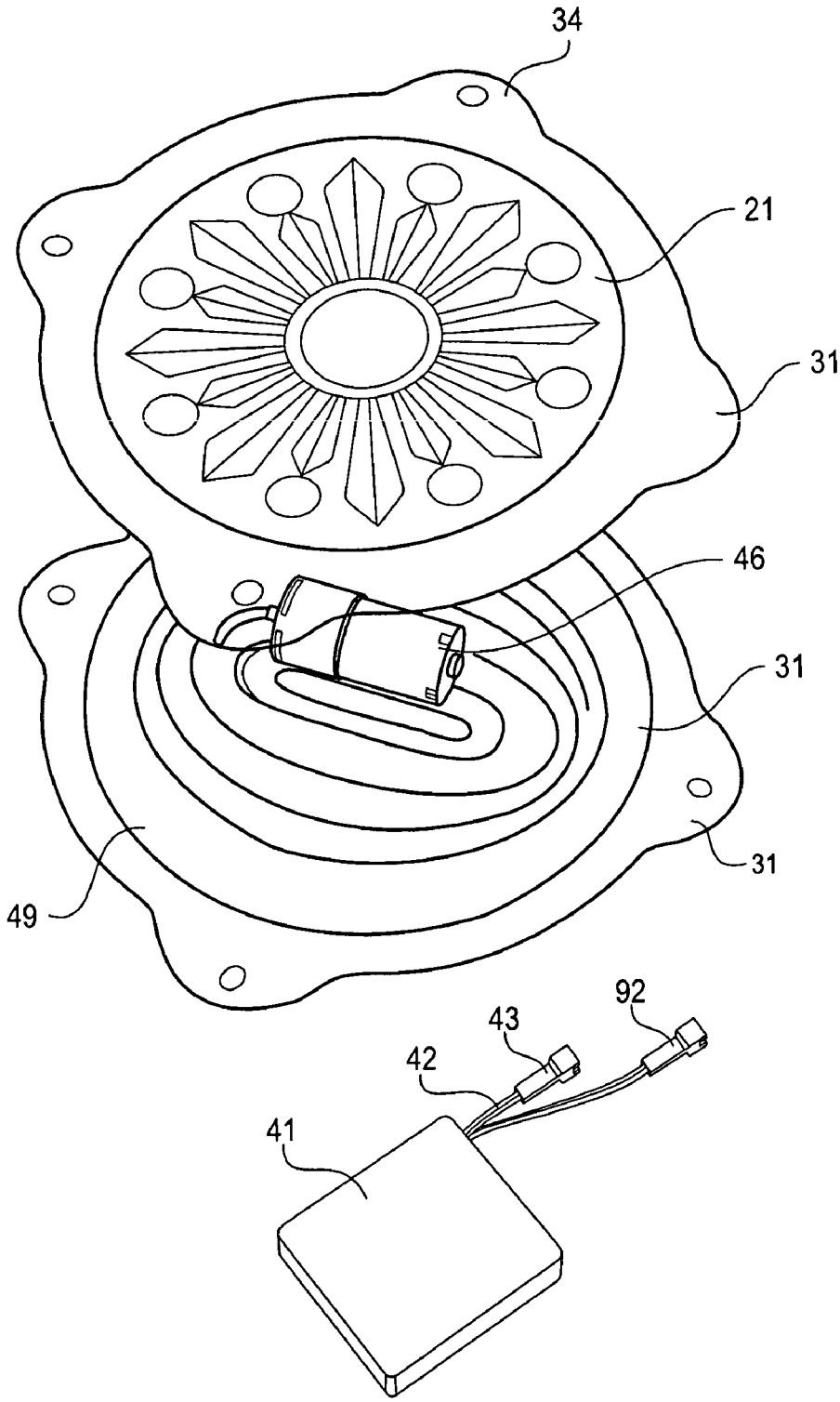
FIG. 2 is an exploded assembly view showing how to assemble the bounce module 20.
Figure 3:
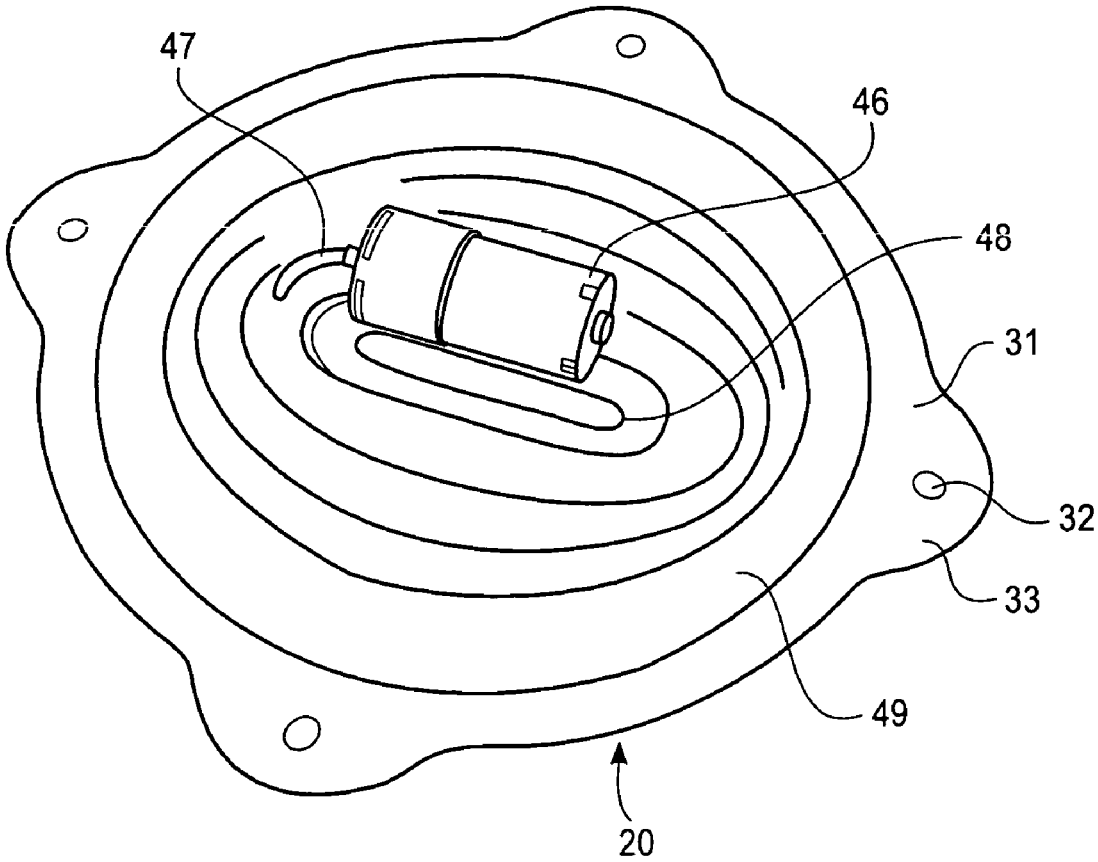
FIG. 3 is a detail view showing the placement of the air pump.
Figure 4:
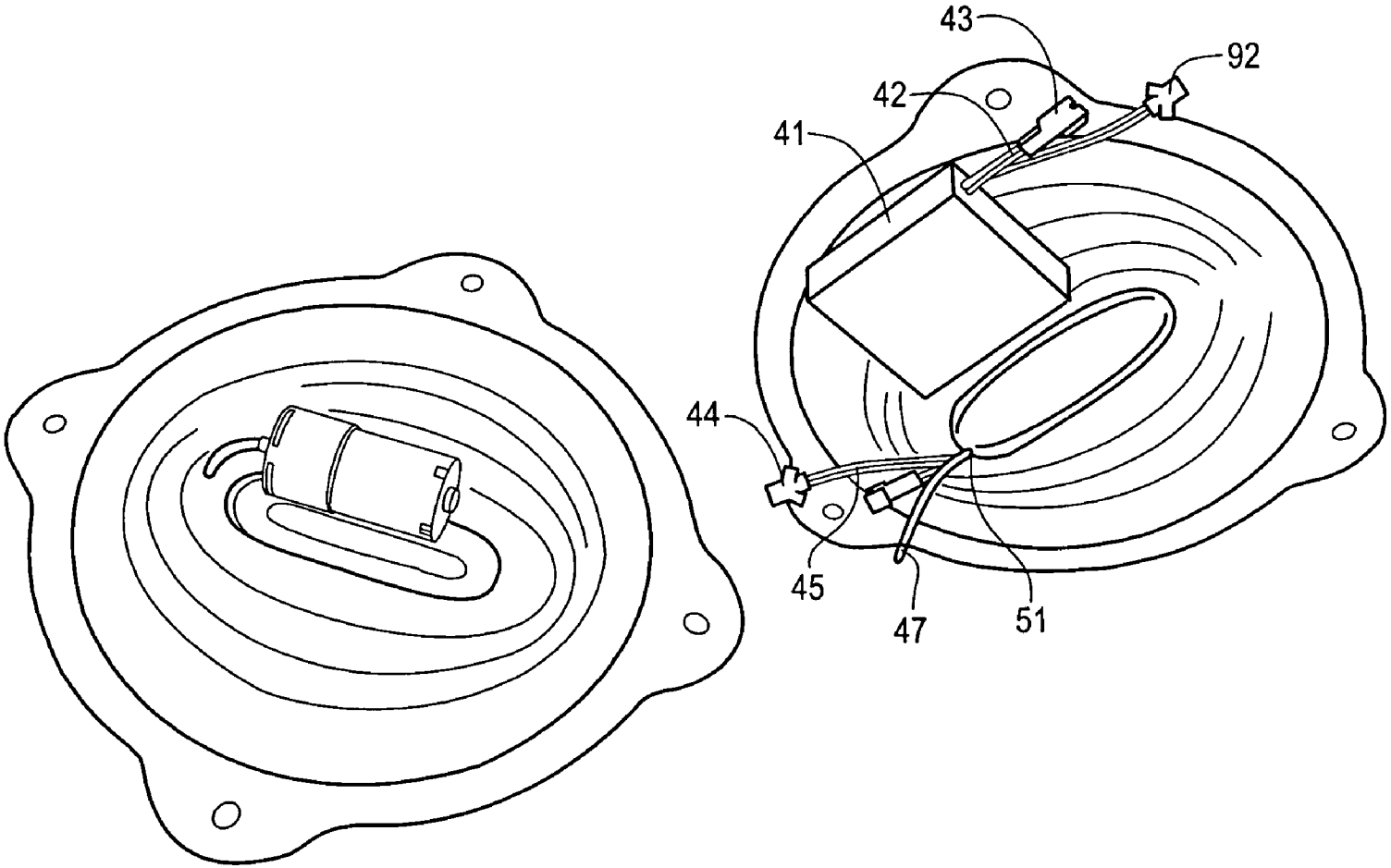
FIG. 4 is another assembly view showing insertion of the wire and hose through the wire opening.
Figure 5:
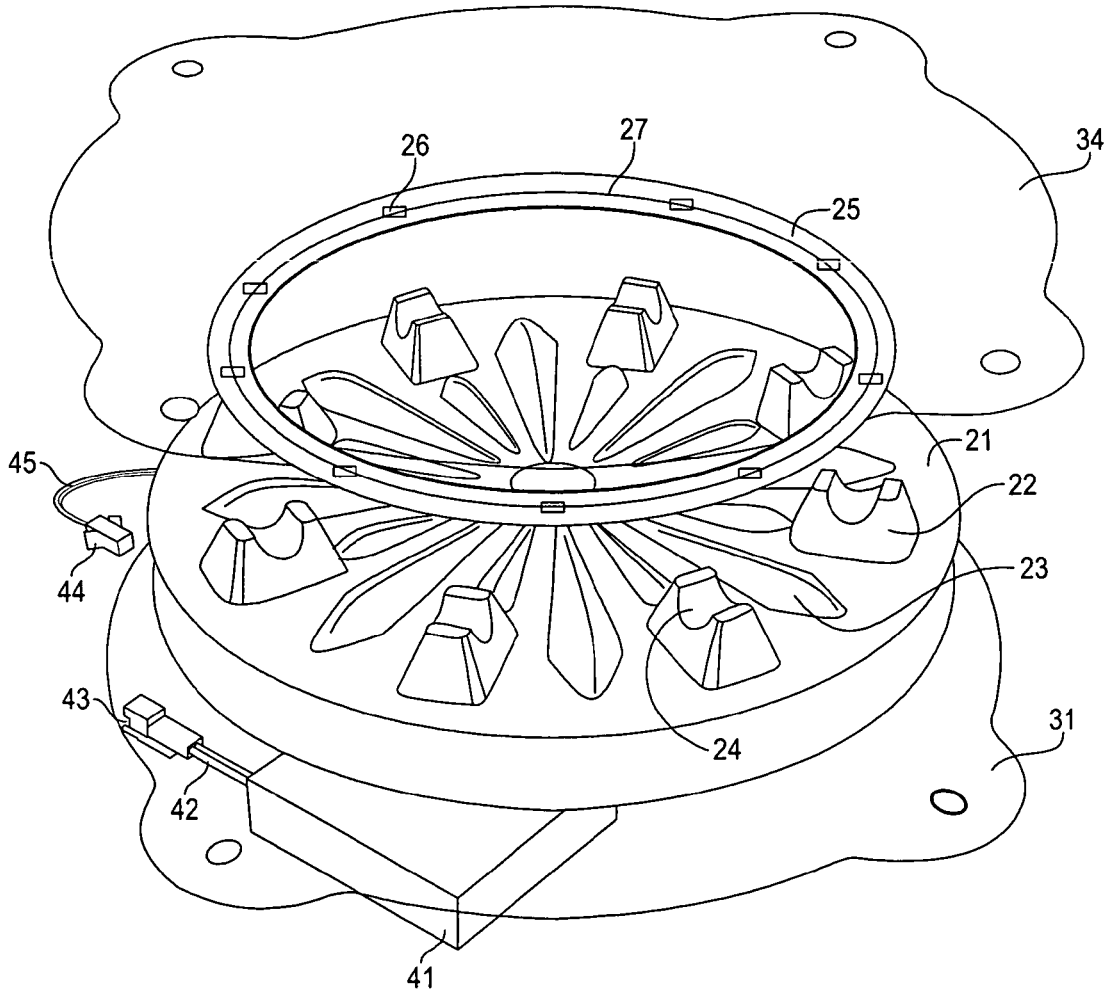
FIG. 5 is a another assembly view diagram showing how to assemble the laminate construction.

The following call out list of elements is used consistently in the drawings as follows:

120 Balloon
121 Balloon Coupler
122 Tube Sleeve
20 Bounce Module
25 Halo
26 Light Emitting Element, LED Element

27 LED Wire
234 Top Cover
31 Bottom Cover
32 Cord Opening
33 Cord Flap
34 Elastic Cord Attachment Area
41 Battery Pack
42 Wire Leads
43 Socket Wire Coupler
44 Wire Plug
45 Light Wire Leads
47 Air Hose
46 Air Pump
49 Lower Disk Baseplate
51 Wire Opening
80 Bounce Sensor
85 Elastic Cord
88 Inflatable Bag
82 Flexible Resilient Spring
83 Post
81 Sheath
84 Base
85 Spring Wiring
86 Post Wiring
92 Pump Plug
91 Pump Socket

DETAILED DESCRIPTION OF THE PREFERRED EMBODIMENT

The key feature of this invention is the balloon 120 that inflates when a user jumps on the trampoline bed which activates a flow of air to an air hose 47. The balloon 120 is connected to a balloon coupler 121. The balloon coupler is preferably shaped as a nozzle allowing a balloon to fit over the coupler. The nozzle may have a circumferential groove or indent around the periphery of the nozzle allowing a neck of the balloon to engage with the groove. The balloon coupler 121 may also include a clip to allow clipping of the neck of the balloon to the nozzle. When the balloon is clipped by the neck, the balloon may inflate until it bursts, and alternatively when the balloon is not clipped, the balloon may detach from the nozzle after the balloon reaches a certain size.

The tube sleeve 122 holds a vertical section of air hose 47 and can be clasped with hook and loop tape so as to allow release and attachment of the tube sleeve 122. The tube sleeve 122 is preferably a fabric tube having a pair of flaps that close over the air hose 47. The tube sleeve 122 is preferably mounted to the trampoline enclosure netting.

The trampoline enclosure is typically a net having an entrance. The entrance can be secured by a zipper. The trampoline also has a trampoline mat extending around a circumferential area of the bounding surface. The trampoline mat covers the springs which are not accessible by a user within the jumping area, because the jumping area is limited to the area above bounding surface. A plurality of legs extend from the support pole. The legs can be U-shaped and formed in sections, namely a first leg section, a second leg section and a bottom section that is also called a leg connection member. The leg connection member connects to the leg first section at a leg connection interface and connects to the leg second section at a leg connection interface. The first leg section is the leg section that connects to the support pole. The second leg section connects to the trampoline frame.

The trampoline frame supports the mat and the bounding surface, and the springs extending between the bounding surface and the mat. The springs are hidden under the mat. When in use, a user exerts force on the structure. A neutral force position can be defined when a user is absent and the structure is not in use. During use, a user jumps up and down on the bounding surface. The bounding surface extends inward and creates moment and exerts force on the trampoline structure.

The bounce module 20 is connected by a plurality of elastic cord 134 connecting to an elastic cord attachment area 34 on the bounce module. The bounce module has preferably a laminate construction including a top cord attachment area flange with an opening for connecting the elastic cord. The laminate construction may include a top cover 234.

The bounce module includes a reflector 21 that is plastic molded and has a reflective surface including a reflector post 22 that has a halo groove 24 for receiving the halo 25. Optionally, a plurality of reflector ribs 23 can be introduced on the surface of the reflector 21 for the purpose of adding an extra angle of viewing for a viewer. The bounce module is preferably substantially rigid and having a disk shape. The trampoline mat 86 is immediately above the module 20 so that when users jump on the trampoline mat, the module moves up and down. The module is suspended by preferably a total of four elastic cord 85 the elastic cord connect to an elastic cord attachment area 34 which then connect to a frame of the trampoline. The module can be suspended by attachment to a frame of the trampoline assembly.

The halo 25 may be constructed of a ring of transparent or translucent plastic. The light elements such as LED elements 26 in the halo may include an LED wire 27. The electrical circuitry is not complicated. The battery pack 41 has a first wire lead 42 that leads to a socket wire coupler 43 which connects to the lighting. The battery pack also has a pump plug 92 which connects to a pump socket 91 for powering the air pump when a user jumps on the trampoline. The battery pack 41 further has a processor such as a CPU or a central processing unit or other type of control circuit which has motion sensing or vibration sensing for activating the lights or pump. The air hose 47 passes through the bottom concave 48 at a wire opening 51. Pump socket 91 also passes through the wire opening 51. The air pump 46 can be connected to household electric current, or can be powered by the battery pack 41.

The reflector is snapped onto the halo 25 and both are sandwiched in between a top cover 234 and a bottom cover 31. It is preferred that the periphery of the top cover 234 is heat laminated to the periphery of the bottom cover 31 so as to form a watertight seal around the periphery in casing the internal components such as the pump and the halo. The battery pack is attached underneath the bottom cover 31 and can be adhered by hook and loop tape or by snaps. The battery pack 41 has a pair of wire leads 42 leading to a socket wire coupler 43. The socket wire coupler 43 connects to a wire plug 44. The wire plug has a pair of light wire leads 45. The reflector 21 has a flat surface meeting with a lower disk baseplate 49. The lower disk baseplate 49 has a bottom concave 48 which is receiving an air pump 46. The air pump 46 has an air hose 47 extending from the air pump. The air hose 47 passes through the baseplate 49. The air pump 46 is also suspended and moving up and down since the cord flap 33 has a cord opening 32 to which the elastic cord is attached.

It is an optional feature to have an inflatable bag 88 resting on the ground and underneath the module 20 so that the inflatable bag 88 is pressed upon when users jump up and down on the trampoline mat 86. The inflatable bag 88 can be kept inflated by an air pump. Fluctuations in the inflatable air bag 88 push air through one-way valves 89 located on the air tube 47 line. The inflatable bag 88 can be inflated by the air pump on the module 20, or by a separate air pump. The inflatable bag 88 is essentially another balloon that has an air intake and air output such that the inflatable bag 88 operates as an air pump. When the users jump on the air pump, the motion of the users is translated into pumping up the balloons 120. The balloons can be pumped up either until they pop or until they fly off. The inflatable air bag can be formed as a bellows structure or as a round balloon. When the pump is continuously inflating the inflatable bag 88, the pump is preferably not connected to the control circuitry, but is preferred to be in continuous operation. The pump could be activated only when motion is sensed, but continuous operation is favored.

The inflatable bag 88 may have a circular base with cylindrical shaped sidewalls. The inflatable bag can be a mechanical pump. The inflatable bag 88 may also have a bellows like, accordion shaped sidewalls so that it can be a mechanical pump. The structure of the bellows pump can be restored by elastic cord or spring to draw in more air to the bellows pump. The base of the inflatable bag preferably sits on the ground surface underneath the trampoline. The inflatable bag can be inflated so that it is wedged between the ground and the module 20. The module 20 provides light as well as a flat surface for a abutting the inflatable bag 88. The inflatable bag may have a cylindrical configuration with a circular top, a circular bottom and cylindrical shaped sidewalls. The circular top and circular bottom are preferably sealed to the cylindrical shaped sidewalls. The bounce module can be integrally formed as a top surface of the bellows structure which abuts the bellow to engage the bellows.

The bounce sensor can be a spring type bounce sensor as described in U.S. Pat. No. 7,297,089 issued to Samuel Chen entitled lighted trampoline, issued Nov. 20, 2007, the disclosure of which is incorporated herein by reference.

Figure 8:
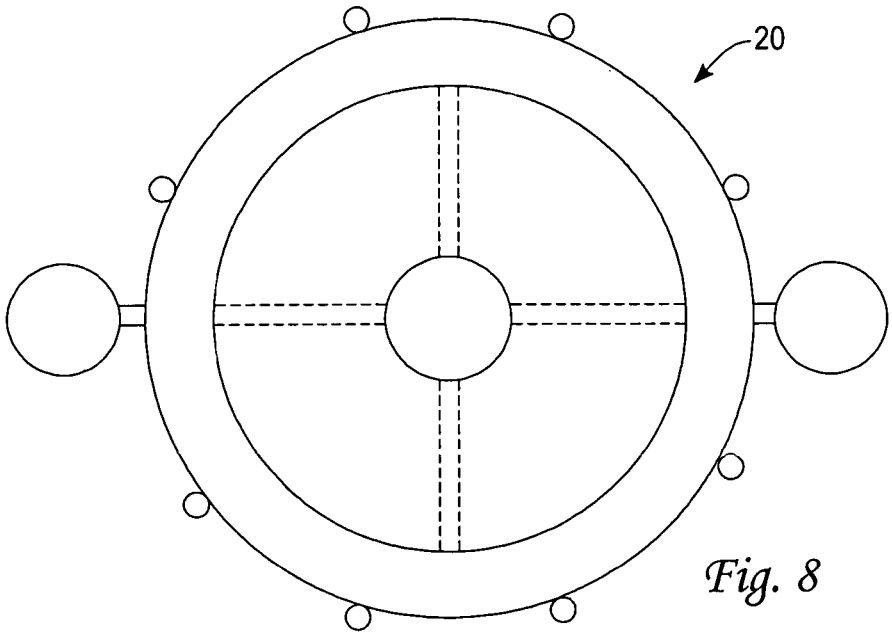
FIG. 8 is a top view of the balloon inflating trampoline showing a pair of balloons inflating.
Figure 6:
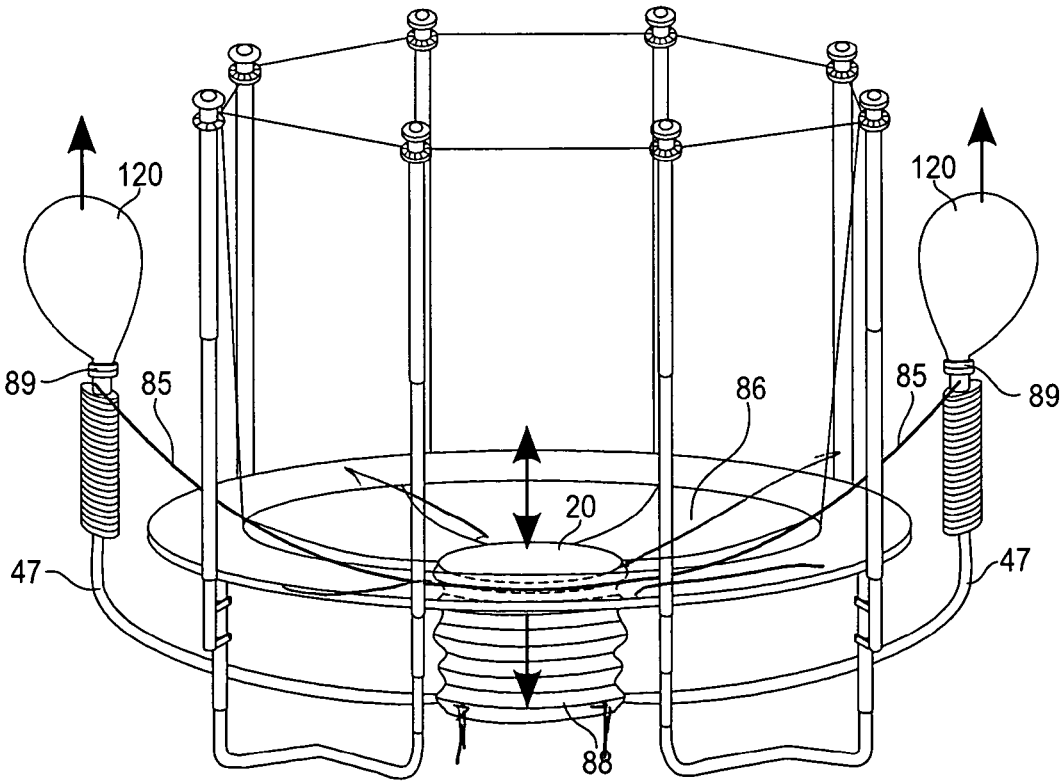
FIG. 6 is a diagram showing the operation of the inflatable bag.
Figure 7:
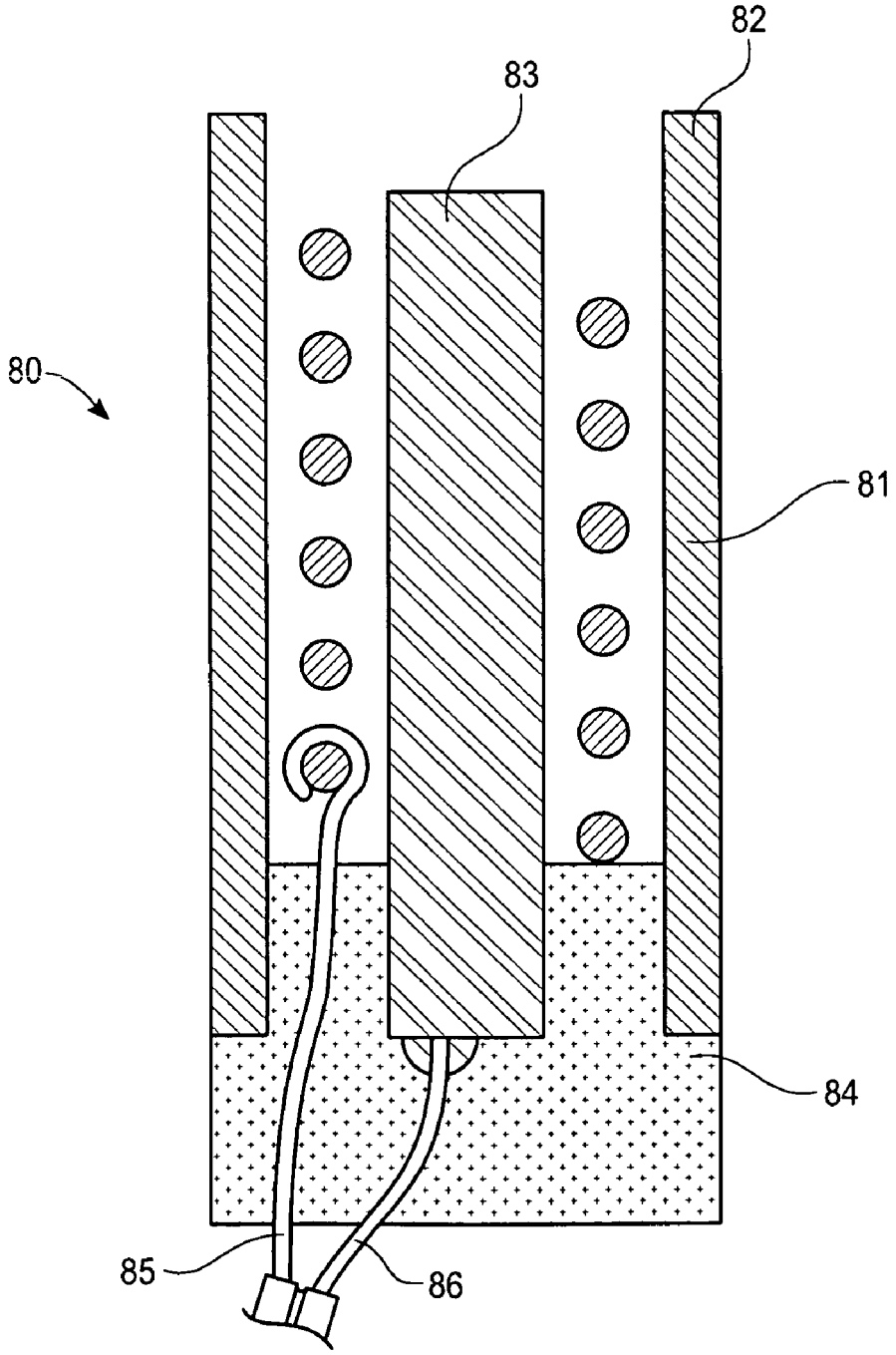
FIG. 7 is a cross-section view of the sensor mounted in the bounce module 20.

It is obvious to pick the best type of sensor from the wide array of sensors depending upon the architectural configuration, mechanical construction and artistic theme of the trampoline. For example, a trampoline having an inflatable structure could use a sound sensor or a pressure sensor mounted inside of the inflatable portion of the structure. If a portion of the inflatable structure is filled with water, a sound sensor can also be used. For trampolines having a bounce mat instead of an inflatable section not holding water or air, the vibration sensor shown on FIG. 8 is the best mode, which is the spring post configuration. The best mode bounce sensor 80 in FIG. 8 has a flexible resilient spring 82 that touches a post 83 when vibrated, or moved so that it closes a circuit sending a signal to lights connected on the circuit. There is optionally a sheath 81 mounted on a base 84 holding two sets of wiring. The spring wiring 85 connected to the post wiring 86.

The pump can also pump water through the water hose for the purpose of filling up water balloons, which could fall off of the coupler or explode when filled beyond capacity. The pump is in fluid communication with the hose and a balloon. The fluid can be water or air. It is preferred that approximately 20 bounces are required to fill a balloon halfway full, and for approximately 40 bounces required to fill a balloon and more than that to pop a balloon.

The invention claimed is:

1. A trampoline comprising:

a. a trampoline bed having a bounding surface, namely a trampoline bed bounding surface;

b. a trampoline frame holding the bounding surface substantially horizontally to provide a jumping area for users;

c. a balloon coupler attached to the trampoline;

d. a bounce module mounted to the trampoline and receiving motion from the trampoline bed when users jump on the trampoline bed;

e. a balloon attached to the balloon coupler, wherein the balloon is in fluid communication with the conduit hose;

f. a conduit hose attached to the balloon coupler;

g. a one-way valve configured to regulate flow only to the balloon, and blocking any flow away from the balloon;

h. a pump, wherein the pump is configured to pump fluid through the conduit hose to the balloon when users jump on the trampoline bed;

i. and j. a least one leg formed on the trampoline frame, and supporting the trampoline frame above the ground.

2. The trampoline of claim 1, further comprising an inflatable bag installed underneath the trampoline bed bounding surface, wherein the inflatable bag is sized to be pressed between the ground and the trampoline bed.

3. The trampoline of claim 2, further comprising a plurality of elastic cord attaching to the bounce module at a cord connection area and attaching to the trampoline frame, wherein the bounce module is mounted underneath the trampoline bed bounding surface, wherein the bounce module is placed to receive motion from a user, wherein a user activates a mode of the bounce module during jumping, wherein the bounce module further includes:

i. a top cover, wherein the top cover is light permeable;

ii. a bottom cover; and iii. a light element sandwiched between the top cover and the bottom cover.

4. The trampoline of claim 2, wherein the bounce module further includes a bounce sensor, wherein the bounce sensor is a spring type bounce sensor.

5. The trampoline of claim 1, further comprising a plurality of elastic cord attaching to the bounce module at a cord connection area and attaching to the trampoline frame, wherein the bounce module is mounted underneath the trampoline bed bounding surface, wherein the bounce module is placed to receive motion from a user, wherein a user activates a mode of the bounce module during jumping, wherein the bounce module further includes:

i. a top cover, wherein the top cover is light permeable;

ii. a bottom cover; and iii. a light element sandwiched between the top cover and the bottom cover.

6. The trampoline of claim 1, further comprising a plurality of elastic cord attaching to the bounce module at a cord connection area and attaching to the trampoline frame, wherein the bounce module is mounted underneath the trampoline bed bounding surface, wherein the bounce module is placed to receive motion from a user, wherein a user activates a mode of the bounce module during jumping, wherein the bounce module further includes a bounce sensor, wherein the bounce sensor is a spring type bounce sensor.

7. The trampoline of claim 1, further comprising a plurality of elastic cord attaching to the bounce module at a cord connection area and attaching to the trampoline frame, wherein the bounce module is mounted underneath the trampoline bed bounding surface, wherein the bounce module further includes a bounce sensor, wherein the bounce sensor is electronically connected to the fluid pump to activate the fluid pump when the bounce sensor detects a bounce, wherein the fluid pump inflates a balloon when the bounce sensor detects a bounce.

8. The trampoline of claim 7, wherein the bounce sensor requires more than 20 bounces to pop a balloon.

9. The trampoline of claim 7, wherein the bounce sensor requires more than 20 bounces to release a balloon from the nozzle.

10. The trampoline of claim 1, further comprising an inflatable bag installed underneath the trampoline bed bounding surface, wherein the inflatable bag is sized to be pressed between the ground and the trampoline bed, wherein the inflatable bag is connected to the hose and providing fluid pressure to the hose.

11. The trampoline of claim 10, wherein the pump is configured to inflate the inflatable bag.

12. The trampoline of claim 11, wherein the bounce module further includes a bounce sensor, wherein the bounce sensor is a spring type bounce sensor.

13. The trampoline of claim 12, further comprising a plurality of elastic cord attaching to the bounce module at a cord connection area and attaching to the trampoline frame, wherein the bounce module is mounted underneath the trampoline bed bounding surface, wherein the bounce module is placed to receive motion from a user, wherein a user activates a mode of the bounce module during jumping, wherein the bounce module further includes a bounce sensor, wherein the bounce sensor is electronically connected to the fluid pump to activate the fluid pump when the bounce sensor detects a bounce, wherein the fluid pump inflates a balloon when the bounce sensor detects a bounce.

14. The trampoline of claim 13, wherein the bounce module further includes:

i. a top cover, wherein the top cover is light permeable;

ii. a bottom cover; and iii. a light element sandwiched between the top cover and the bottom cover.

15. The trampoline of claim 14, wherein the bounce module further includes a bounce sensor, wherein the bounce sensor is electronically connected to the fluid pump to activate the fluid pump when the bounce sensor detects a bounce, wherein the fluid pump inflates a balloon when the bounce sensor detects a bounce.

16. The trampoline of claim 1, further comprising a plurality of elastic cord attaching to the bounce module at a cord connection area and attaching to the trampoline frame, wherein the bounce module is mounted underneath the trampoline bed bounding surface, wherein the bounce module is placed to receive motion from a user, wherein a user activates a mode of the bounce module during jumping.

17. The trampoline of claim 16, wherein the trampoline frame includes a trampoline and closure having a trampoline and enclosure netting, wherein the balloon coupler is attached to the trampoline at the enclosure netting.

18. The trampoline of claim 16, wherein the balloon coupler and hose are held by a pair of closable flaps forming a sleeve.

19. The trampoline of claim 1, wherein the trampoline frame includes a trampoline and closure having a trampoline and enclosure netting, wherein the balloon coupler is attached to the trampoline at the enclosure netting.

20. The trampoline of claim 1, wherein the balloon coupler and hose are held by a pair of closable flaps forming a sleeve.

* * * * *